United States Patent [19]

Muller

[11] 3,989,218

[45] *Nov. 2, 1976

[54] CANTILEVER FORM USED IN BRIDGE CONSTRUCTION

[75] Inventor: Jean M. Muller, Suresnes, France

[73] Assignee: Societe d'Etudes de Genie Civil et de Techniques Industrielles (GE.C.T.I.), Paris, France

[ * ] Notice: The portion of the term of this patent subsequent to Aug. 5, 1992, has been disclaimed.

[22] Filed: May 1, 1975

[21] Appl. No.: 573,794

Related U.S. Application Data

[63] Continuation of Ser. No. 380,106, July 17, 1973, abandoned.

[52] U.S. Cl. ..... 249/20; 14/1; 264/33

[51] Int. Cl.[2] ..... E01D 1/00; E04G 9/00

[58] Field of Search ..... 249/19–22; 425/62–63; 264/33–35; 52/126, 745; 14/1

[56] References Cited

UNITED STATES PATENTS

| | | | |
|---|---|---|---|
| 1,591,907 | 7/1926 | Yager | 249/20 |
| 1,685,012 | 9/1928 | Yager | 249/20 |
| 2,963,764 | 12/1960 | Finsterwalder | 264/34 |
| 3,003,219 | 10/1961 | Suter et al. | 264/33 |
| 3,299,191 | 1/1967 | Mantscheff et al. | 264/34 |
| 3,490,605 | 1/1970 | Ross | 264/34 |
| 3,495,800 | 2/1970 | Fisher | 249/20 |
| 3,571,835 | 3/1971 | Buechler | 264/33 |
| 3,579,759 | 5/1971 | Zuccolo | 425/62 |
| 3,897,927 | 8/1975 | Muller | 249/20 |

FOREIGN PATENTS OR APPLICATIONS

| | | | |
|---|---|---|---|
| 1,516,851 | 2/1968 | France | 14/1 |

*Primary Examiner*—Francis S. Husar
*Assistant Examiner*—John McQuade
*Attorney, Agent, or Firm*—James D. Halsey, Jr.; H. J. Staas

[57] ABSTRACT

A concreting rig for use in construction by the cantilever method of an elevated, elongated civil engineering work, such as a bridge, elevated road, roof or the like, by in situ concreting longitudinally consecutive sections of the work with the rig overhanging beyond the already completed portion of the work, comprises a rigid structural frame which is longitudinally pressed against the already completed portion of the work, by means of tensioned prestressing members. The rig bears on the already completed work portion by way of at least three abutment devices each of which engages with a complementarily-shaped locating print in the completed work portion, means being provided for predetermining the position of each locating print in dependence upon the geometric characteristics of the work and the position therein, of the section to be concreted.

3 Claims, 26 Drawing Figures

FIG.: 17
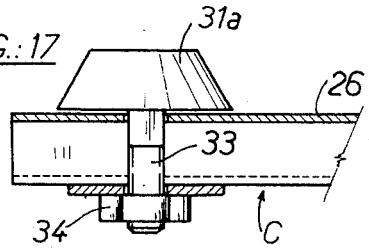
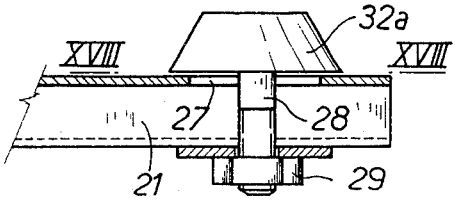
FIG.: 19
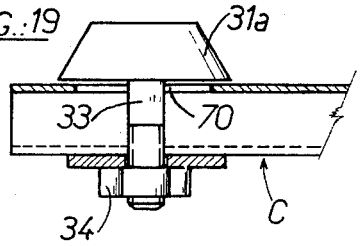
FIG.: 18
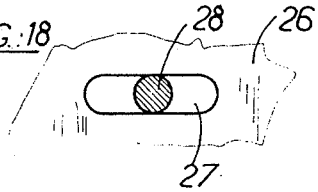
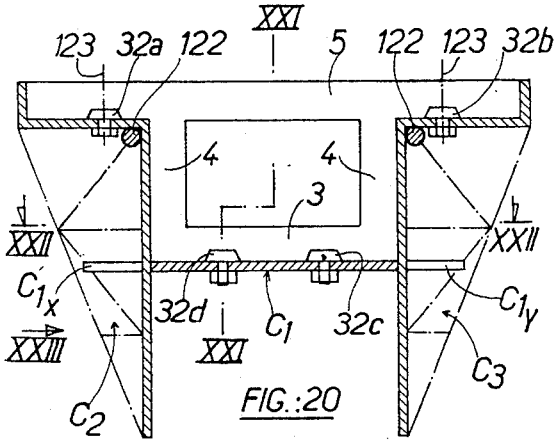
FIG.: 20
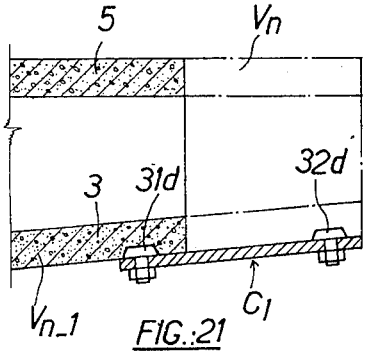
FIG.: 21
FIG.: 22
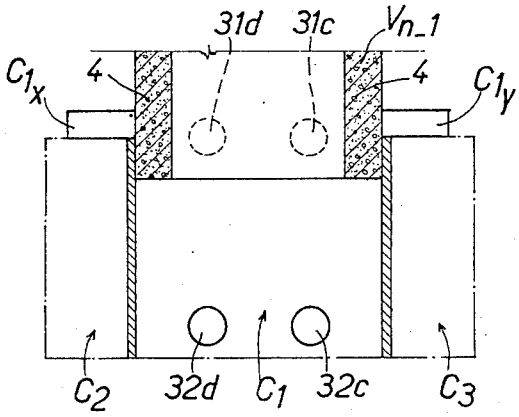
FIG.: 23
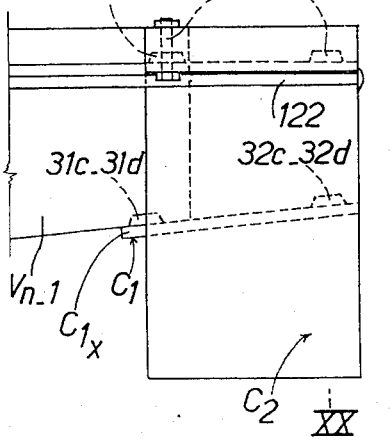

CANTILEVER FORM USED IN BRIDGE CONSTRUCTION

This is a continuation, of application Ser. No. 380,106, filed July 17, 1973 now abandoned.

This invention relates to an installation including a cantilever-type; concreting rig for construction of an elevated, elongated civil engineering work, such as a bridge or elevated road or roof or the like, by in situ concreting a plurality of substantially horizontally-extending, longitudinally consecutive sections of the work, the rig longitudinally overhanging beyond an already-completed portion of the work at the place where a new or fresh section is to be concreted.

It is a general object of the invention to improve conventional concreting rigs as regards safety in use and their adjustment in dependence upon the geometric characteristics of the work to be concreted.

We shall first briefly review a conventional construction installation with reference to FIGS. 1 and 2 of the accompanying drawings.

Referring to FIG. 1, a work such as a bridge 2 is built out from a pier 1, in the form of substantially horizontally-extending longitudinally consecutive sections each formed by in situ concreting; this form of construction is known as cantilevering or the cantilever method. The work 2 comprises e.g. a box girder, which has a cross-section as shown in FIG. 2 and comprises a bottom flange 3, two webs 4 and a top flange 5. Two sections $V_n$, $W_n$ which are symmetrical about the pier 1 are shown in the course of construction.

Associated with each such section under construction is a concreting rig 8 which comprises mould members 9 and longitudinally overhangs beyond the already completed portion of the work 2. Through the agency of hangers 11 the rig 8 is slung from a bearing scaffolding 7 which in turn bears via legs 12 on the already completed portion of the work 2. The scaffolding 7 is also secured to the already completed portion of the work by means of anchor rods 13. Consequently, the load resulting from the weight of the rig 8 and from the weight of the section $V_n$ being concreted is transferred via the hangers 11 and the scaffolding 7 to the already completed portion of the work 2.

The box-girder bottom flange 3, webs 4 and top flange 5 are concreted consecutively. After the concrete has set the sections $V_n$ and $W_n$ are permanently secured to the already completed portion of the work by means of prestressed reinforcing members (not shown) and the two rigs are advanced symmetrically so that the next sections can be concreted.

These systems have disadvantages. One disadvantage is the difficulty of adjusting the rig 8 accurately to adapt it to the geometric characteristics of the required work, more particularly when the pattern or course thereof varies, for example because of a non-uniform longitudinal profile, a variable plan curvature, e.g. an S-curve, or a possible reversal of superelevation, or any combination of such features. Another disadvantage arises from the fact that the weight of the section actually being concreted deforms the suspension — i.e. the parts 11 and 7 of the rig 8. At least two disadvantages arise from such deformability. Firstly, rig adjustment is made more complicated, and secondly cracking of the concrete, more particularly in the zone of the bottom flange 3 and webs 4, when the top flange 5 is being concreted, may be caused thereby.

It is an object of the invention to obviate or at least reduce these disadvantages. A first object of the invention is to improve the rig suspension so as to compensate for the tendency of the known suspensions to deform and, thus, improve the accuracy of rig adjustment and reduce the risks of the concrete cracking.

To this end, according to one aspect of the invention, the rig comprises a rigid structural frame which is pressed, in the longitudinal direction of the work, against the already completed work portion by means of tensioned main prestressing members.

According to a feature of the invention, the prestressing members comprise at least one main prestressing member extending lengthwise of the work. The main prestressing member can, for instance, have one end anchored to the rigid structural frame near the rig front part — i.e. the rig part furthest away from the already completed portion of the work — the other end of the main prestressing member being anchored to the penultimate section of the already completed portion of the work. Preferably, the main prestressing member extends near the top zone of the rig, entirely outside the volume of the section of the work to be concreted. Preferably too, two main prestressing members are provided which extend lengthwise of the work on either side of the volume taken up by the section of the work to be concreted.

According to another feature of the invention, there is further provided at least one, and preferably two, auxiliary prestressing members extending substantially in the vertical direction of the work. Advantageously, the or each auxiliary prestressing member has one end anchored to the rigid structural frame near the rig rear part — i.e. the rig part nearest the already completed portion of the work — while the other end of the auxiliary prestressing member is anchored to the last section of the already completed portion of the work.

A second aspect of the invention, which can be used independently of the first, is to facilitate adjustment of the rig, more particularly with a view to enabling works of any kind of pattern or course to be built.

To this end, the rig bears on the already completed portion of the work by way of at least three abutment devices each of which can be either in relief, for example a pin or stud, or recessed, for example a notch or recess, and which engages with a complementarily shaped locating print in the already completed section of the work; and means are provided for preadjusting the position of such locating prints in dependence upon the geometric characteristics of the work and the position in said work, of the section to be concreted.

According to a feature of the invention, the rig also comprises, to the same number as there are abutment devices, at least three auxiliary mould members for moulding the locating prints which will subsequently co-operate with the abutment devices during the concreting of the next section of the work.

The means for preadjusting the position of the said locating prints comprise means for altering the position, relatively to the remainder of the rig, of at least one of said auxiliary mould members; and/or of at least one of said abutment devices relatively to the remainder of the rig. Preferably, the latter means enable each auxiliary mould member and/or each abutment device to be shifted lengthwise of the work.

As will be described hereinafter, if the shiftings of one or more of the auxiliary mould members (and/or the shiftings of one or more of the abutment devices)

are devised appropriately, the rig can be made to take up a predetermined position and angular attitude in dependence upon the geometric characteristics of the required work. This makes it possible to follow any kind of three-dimensional pattern or course in any combination of variations of curvature in plan and/or longitudinal profile and/or superelevation.

Also, the longitudinal thrust produced by the tensioning of the main prestressing members can be transmitted to the already completed portion of the work via the rig abutment devices.

The following description of the accompanying exemplary non-limitative drawings will show clearly how the invention can be carried into effect.

In the drawings:

FIG. 17 is a longitudinal section, to a larger scale than the previous Figures, of a part of the concreting rig comprising more particularly abutment devices and auxiliary mould members;

FIG. 18 is a cross-sectional view on the line XVIII—XVIII of a detail of the rig part shown in FIG. 17;

FIG. 19 is a view similar to FIG. 17 but shows a variant;

FIG. 20 is a cross-sectional view on the line XX—XX of FIG. 23, showing another embodiment of a concreting rig according to the invention;

FIGS. 21 and 22 are cross-sectional views on the lines XXI—XXI and XXII—XXII respectively of the rig of FIG. 20;

FIG. 23 is an elevation of the rig of FIG. 20 looking in the direction of an arrow XXIII in FIG. 20;

Figure 1:
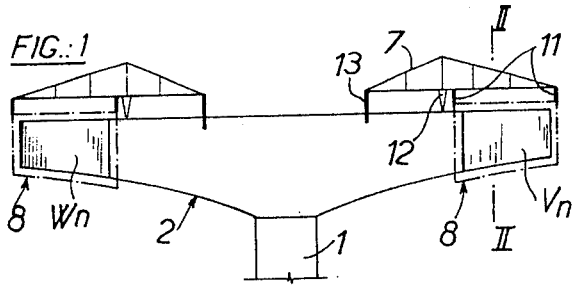
FIG. 1 is a diagrammatic longitudinal elevation of a work, such as a bridge, being constructed with the help of a conventional installation.
Figure 2:
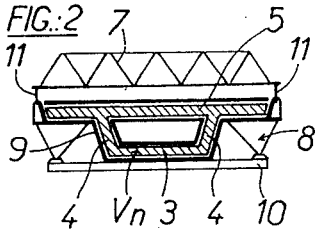
FIG. 2 is a diagrammatic view on the section line II—II of FIG. 1 of the work. Both these Figures have already been described.
Figure 3:
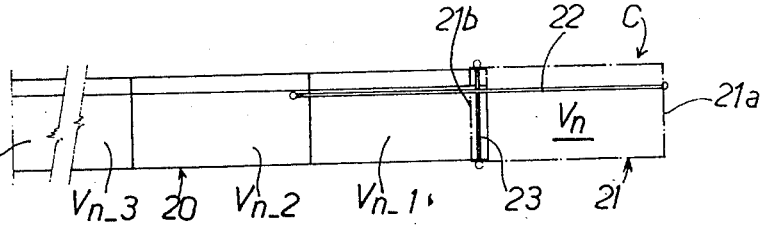
FIG. 3 is a diagrammatic longitudinal elevation of a work under construction, the construction method used being in situ concreting by means of a rig which according to the invention is pressed against the completed portion of the work, by means of tensioned prestressing members.

Referring to FIG. 3, an elevated, elongated civil engineering work 20, such as a bridge or an elevated highway or a roof or the like, is being constructed, using the cantilever method of construction, by successively in situ concreting a plurality of substantially horizontally extending, longitudinally consecutive sections $V_1, \ldots V_{n-3}, V_{n-2}, V_{n-1}, V_n$ of the work. It is assumed that the portion comprising sections $V_1$ to $V_{n-1}$ has already been completed, and so sections $V_{n-2}$ and $V_{n-1}$ are the penultimate and last section respectively of the completed portion. As in the case of the conventional construction installation illustrated in FIGS. 1 and 2, the consecutive sections of the already completed portion of the work are permanently secured together by means of prestressed reinforcing members (not shown). It is assumed that a new or fresh section $V_n$ is being concreted through the agency of a rig C.

Figure 15:
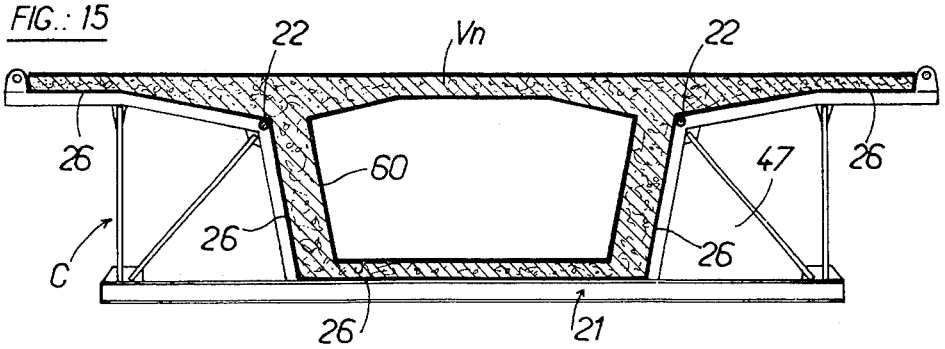
Figure 16:
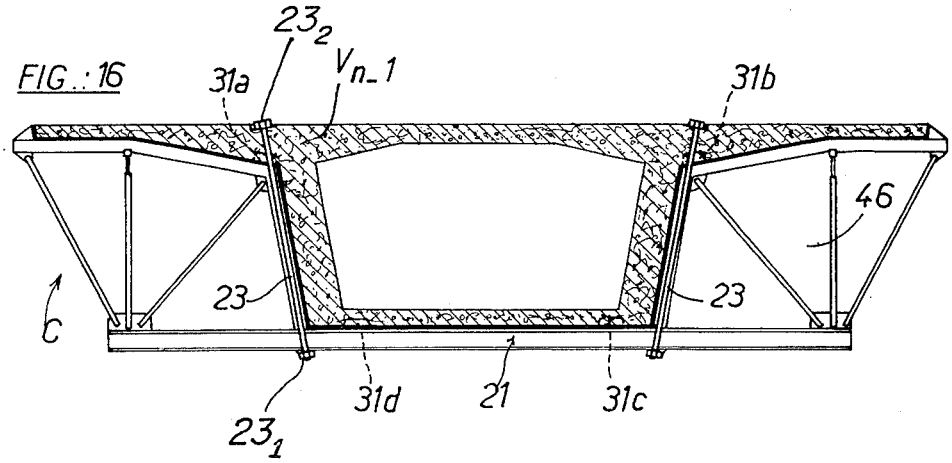

The rig C longitudinally overhangs from the already completed portion of the work in the zone corresponding to the new or fresh section $V_n$ to be concreted. As can be seen e.g. in FIG. 15, the rig C has a number of longitudinally extending main mould members, namely, outside shuttering or mould members 26 and inside shuttering or formwork surfaces 60.

The rig C also comprises a self-supporting structure or structural frame 21 to which the main mould members 26 and 60 are rigidly secured by means not shown. The structure frame 21; comprises a front part 21*a*, which is remote from the already completed portion of the work 20, and a rear part 21*b*, which slightly overlaps the already completed portion of the work 20. The structural frame 21 is secured to the already completed portion of work 20 by means of tensioned prestressing members.

The prestressing members comprise at least one main prestressing member, such as a rod 22, extending lengthwise of the work 20, and at least one auxiliary prestressing member, such as a rod 23, which extends substantially in the vertical direction of the work. The main prestressing member 22 has one end anchored to the structural frame 21 near the front part 21*a* thereof and has its other end anchored in the already completed part of the work, preferably in the penultimate section $V_{n-2}$. Similarly, the vertically extending prestressing member 23 has one end anchored to the structural frame 21 near the rearward part 21*b* thereof and the other end anchored in the last section $V_{n-1}$ of the already completed portion of the work 20.

Preferably, and as can be seen more particularly in FIGS. 11 to 16, there are two main prestressing members 22 and two auxiliary prestressing members 23. Each of the main prestressing members 22 extends lengthwise of the work near the top zone of the rig C and on either side of the space taken up by the section $V_n$. The main prestressing members 22 are anchored by means of anchorage members 24, 25, visible in FIGS. 11 and 13. Each anchorage member 24 is rigidly secured to the front part 21*a* of structural frame 21 while anchorage member 25 is secured near the front end of the penultimate section $V_{n-2}$. Similarly, the auxiliary prestressing members 23, which both extend through a corresponding substantially vertical bore in the last section $V_{n-1}$ of the already completed portion of the work, are anchored by means of anchorage members $23_1$ and $23_2$ visible in FIGS. 11 and 16. Each anchorage member abuts against an undersurface of the rearward part 21*b* of the rigid structural frame 21, which each anchorage member $23_2$ abuts against an upper surface of said last section $V_{n-1}$.

The rigid structural frame 21 abuts against the already-completed portion of the work, in the longitudinal direction towards said completed portion, via abutment means 31*a*, 31 *b*, 31*c*, 31*d* rigidly secured to said frame and which will be described in detail hereinafter.

Prestressing of the prestressing members 22 and 23 is effected in a conventional manner by putting them under tension, for example by means of hydraulic machinery (not shown) as well known in the art.

When the prestressing members 22 are put under tension, the rigid structural frame 21 is strongly pressed, in the longitudinal direction, via the abutment means 31*a*, 31*b*, 31*c*, 31*d*, against the already completed portion of the work.

Consequently, when the prestressing members 22 and 23 are under tension, the rigid structural frame 21 constitutes the equivalent of a prestressed box girder which temporarily extends the already completed portion of the work. The structural frame 21 can now bear not only its own weight but also the weight of the new section $V_n$ being concreted, the bending and shear strength of the complex formed by the already completed portion of the work and the structural frame 21 being provided by prestressing arising from the tensioning of the members 22 and 23.

Also, the tension of the prestressing members can be adjusted so that the rig C is given an initial deformation or negative sag to cancel out deformations caused by the weight of the new section $V_n$ so that the same when concreted is at the desired calculated theoretical position. Adjustment of the rig is therefore simplified and there is a considerable reduction in the risks of the concrete cracking previously mentioned. The heavy and bulky scaffolding 7 shown in FIGS. 1 and 2 can be omitted and replaced by a light handling frame 50 which can be seen more particularly in FIGS. 11, 12 and 14 and which is used just to facilitate the advance and the positional adjustment of the rig C alone — i.e. without its load of concrete.

The use of prestressing gives rise in the complex $V_{n-1}$-21 to longitudinal compression stresses which are at a maximum in the top girder flange 5. So that such stresses may be transmitted readily without the rig C slipping relatively to the already completed portion of the work, a number of features are provided which will now be described with reference to FIGS. 4 to 10 and 17 to 19.

Figure 4:
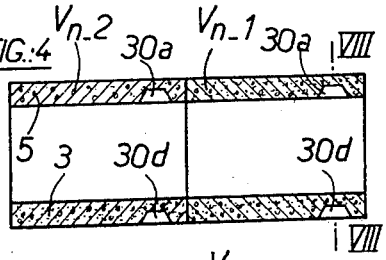
FIGS. 4 and 5 are views on the line IV—IV of FIG. 8 and V—V of FIG. 9, respectively, diagrammatically showing two consecutive phases in the construction of a work by in situ concreting, using a rig having abutment devices and auxiliary mould members according to the invention.
Figure 8:
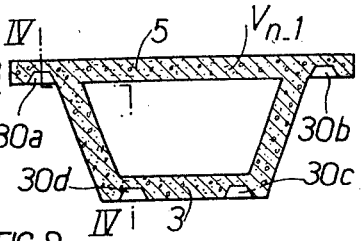
FIGS. 8, 9 and 10 are cross-sectional views on the line VIII—VIII, IX—IX and X—X respectively of the work shown in FIGS. 4, 5 and 6.
Figure 5:
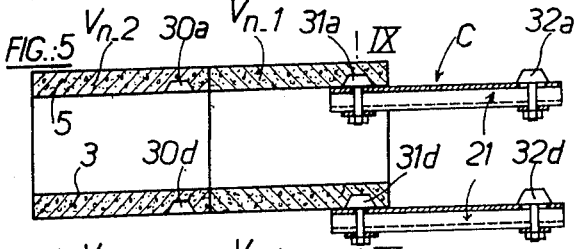
Figure 9:
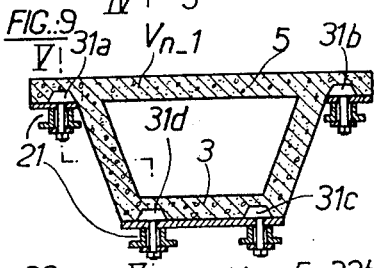

Referring to FIGS. 4 and 8, it will be seen that the last completed section $V_{n-1}$ is formed with a plurality of locating prints 30*a*, 30*b*, 30*c*, 30*d*, there being at least three and preferably, as illustrated, four locating prints. Advantageously, the locating prints are distributed at the corners of a quadrilateral extending transversely of the work. As is shown e.g. by FIGS. 5 and 9, the locating prints are adapted to co-operate with the abutment devices 31*a*, 31*b*, 31*c*, 31*d* already mentioned hereinbefore and which are rigidly secured to the structural frame 21. The abutment devices can be, for example, projecting items, such as pins or studs or the like in which case the locating prints are recesses or depressions, as illustrated. However, the converse system can also be used and at least some of the abutment devices can be recessed items, such as notches or the like, which engage with complementarily-shaped locating prints in the form of projections on the section $V_{n-1}$.

Figure 6:
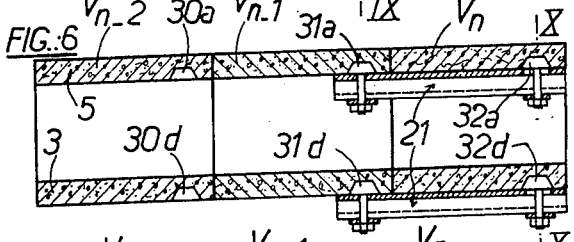
FIGS. 6 and 7 are views similar to FIGS. 4 and 5 showing two other phases in the construction of the work.
Figure 10:
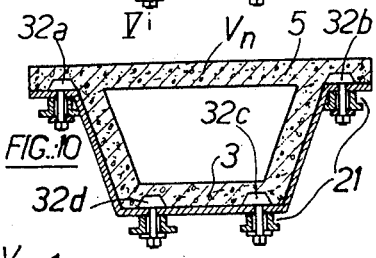
Figure 7:
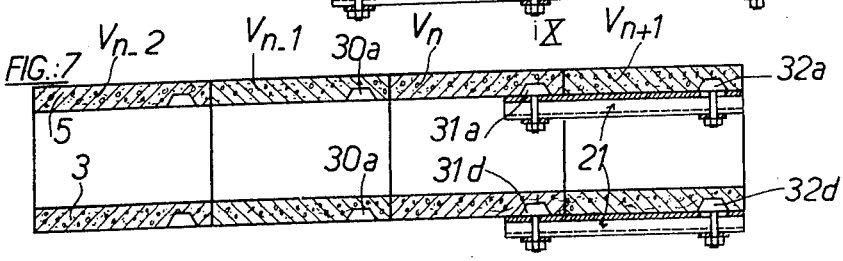
Figure 11:
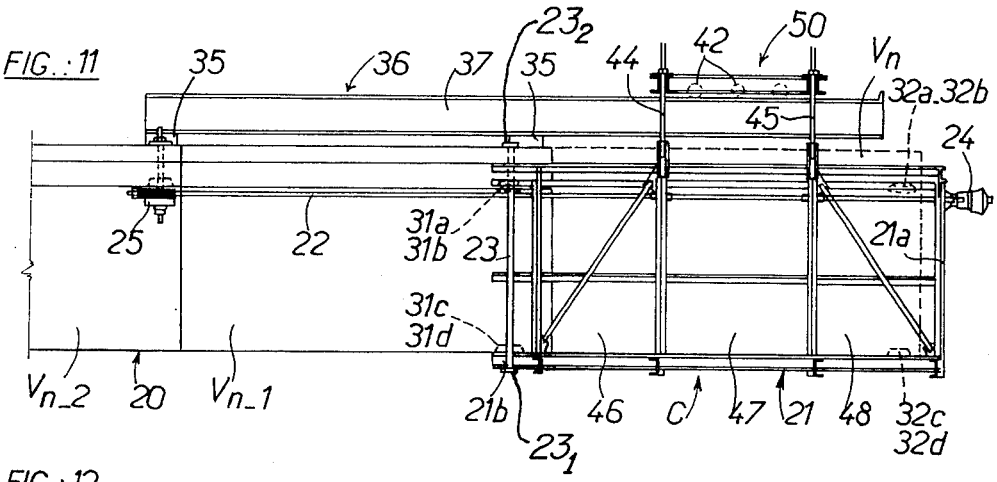
FIG. 11 is a longitudinal elevation of an embodiment of a concreting rig according to the invention temporarily suspended on an adjustableposition handling frame.
Figure 12:
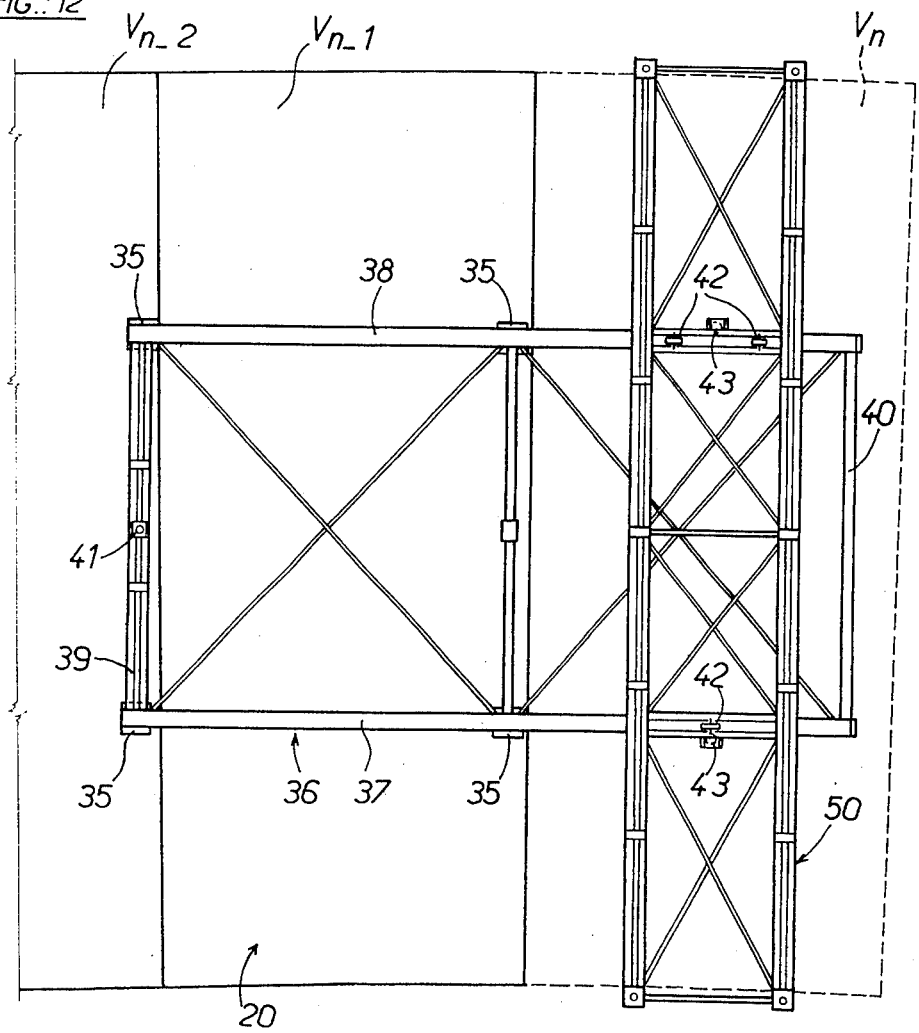
FIG. 12 is a plan of the handling frame of FIG. 11.
Figure 13:
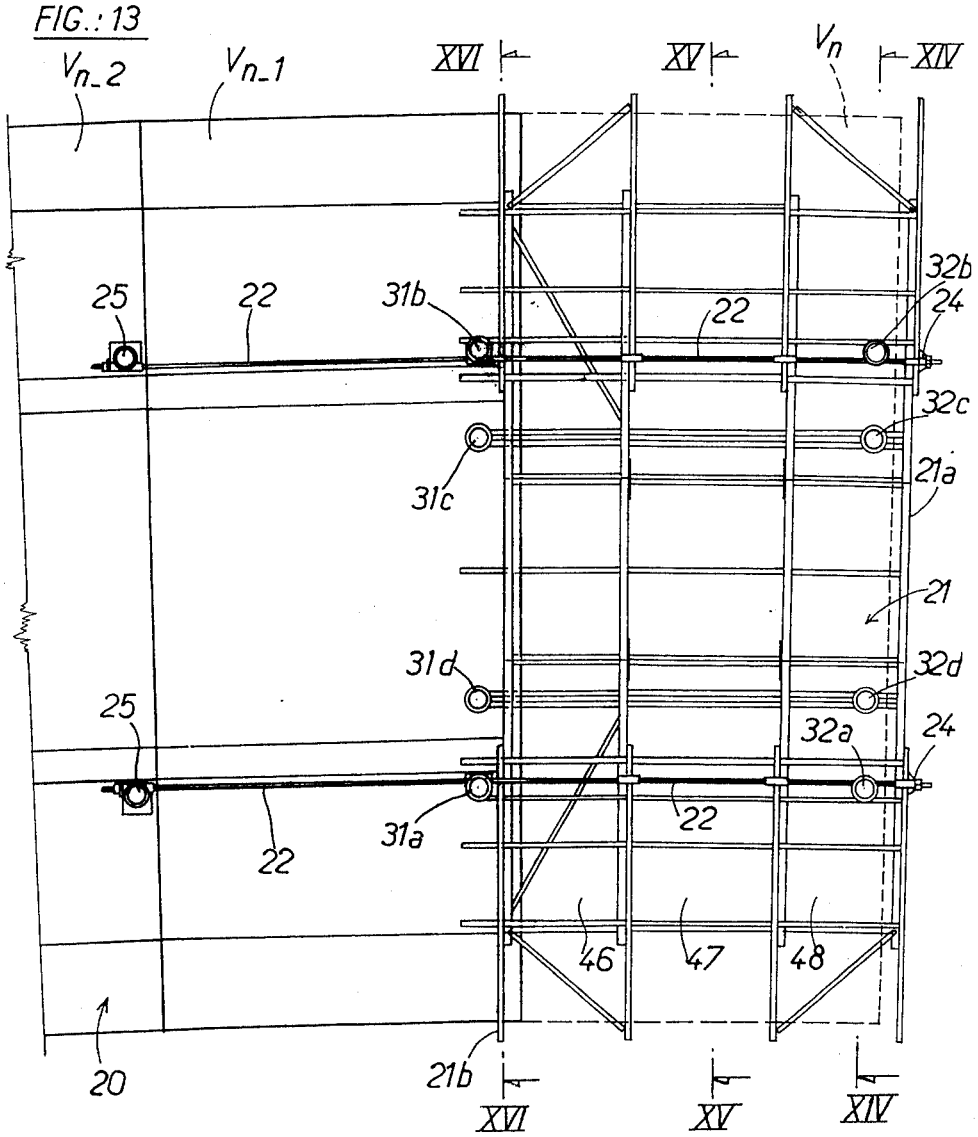
FIG. 13 is a plan of a rigid structural frame forming part of the concreting rig and pressed against the already completed portion of the work by means of reinforcing prestressing members.
Figure 14:
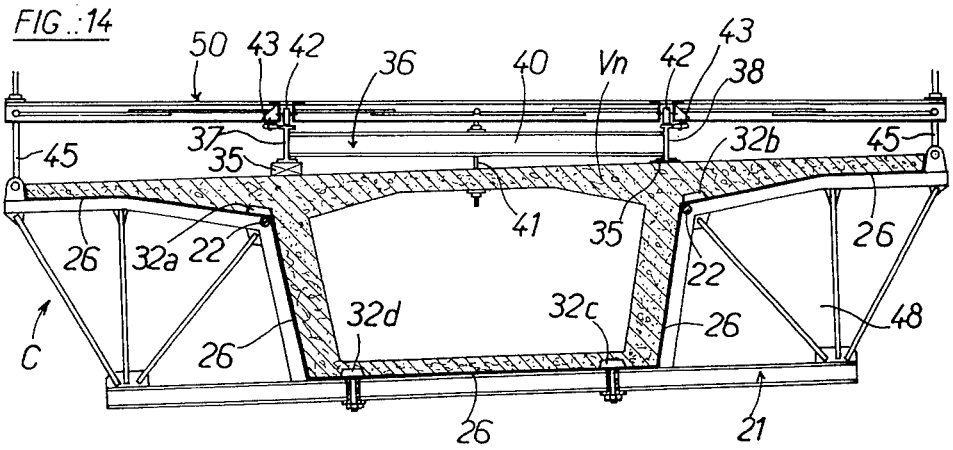
FIGS. 14, 15 and 16 are cross-sectional views on the lines XIV—XIV, XV—XV and XVI—XVI respectively of FIG. 13.

Structure 21 has also a plurality of auxiliary mould members 32*a*, 32*b*, 32*c*, 32*d* rigidly secured thereto which are provided in the same number as there are abutment devices and which serve to mould the locating prints 30*a*, 30*b*, 30*c*, 30*d* which will subsequently co-operate with the abutment devices when the next section $V_{n+1}$ of the work is concreted (see FIGS. 6 and 7).

The co-operating abutment devices and locating prints ensure that the rig C cannot shift relatively to the already completed section $V_{n-1}$, so that the position of the rig C is completely determined by the position of the abutment devices 31*a*, 31*b*, 31*c*, 31*d*.

According to a very advantageous feature of the invention, (and one which can be used independently of the prestressing securing process as so far described), the cooperation just outlined is the means of enabling a civil engineering work to be built with any sort of evolving pattern or course in a very simple way, for since the rig position is determined by the position of the abutment devices, which position in turn depends upon the position of the locating prints, if the position of at least some of the locating prints is determined beforehand, then the position and angular attitude of the rig C can be altered in accordance with the required course or pattern of the work and with the position therein of the next section $V_n$ to be concreted.

To this end, the auxiliary mould members 32*a*, 32*b*, 32*c*, 32*d* and/or the abutment devices 31*a*, 31*b*, 31*c*, 31*d* (or at least some of such mould members and/or abutment devices) are positionally adjustable relatively to the remainder of the rig C, as can be seen more particularly in FIGS. 17 to 19.

Referring to FIGS. 17 and 18, there can be seen a main mould member 26, which is formed with a slot 27 whose major dimension extends in the longitudinal direction of the rig, i.e., substantially parallel to the length of the work 20 and through which a screwthreaded pin 28 extends, one end of the pin 28 having an auxiliary mould member (shown as 32*a*) while the other end co-operates with a clamping nut 29 bearing on structure 21. To adjust the position of the auxiliary mould member 32*a* relatively to the remainder of the rig C, the nut 29 is slackened and the pin 28 is shifted along a longitudinal path in the slot 27. The auxiliary mould member can thus be fixed in any preselected position within said longitudinal path. There can be seen in FIGS. 17 and 19 the abutment device 31*a* which is secured to the rig C by means of a screwthreaded pin 33 and a nut 34. In the embodiment shown in FIG. 17, the position of the abutment device 31*a* relatively to the remainder of the rig C cannot be varied; however, this invariability is not essential and the system shown in FIG. 19 could be used instead, with the pin 33 sliding in a slot 70 similar to the slot 27 of FIG. 17. It would also be possible for the element 31*a* to be a variable-position abutment device whereas the auxiliary mould member 32*a* would be in a fixed position relatively to the rig C.

A description will be given hereinafter with reference to FIGS. 24 to 26 of ways of adjusting the position of the locating prints 30*a*, 30*b*, 30*c*, 30*d* to enable the position and attitude of the rig C to be adapted to the geometric characteristics of the required work.

FIGS. 11 to 16 are more detailed views of the concreting rig. These Figures contain the main elements hereinbefore described, which have the same references. It is assumed that the required work 20 is to have a horizontal curvature, which can be seen in FIGS. 12 and 13, and a superelevation or transverse slope, which can be seen in FIG. 14. Bearing on the completed portion of the work with the interposition of chocks 35 is a stationary frame 36 comprising two longitudinal members 37, 38 and two cross-members 39, 40. The horizontal orientation of the frame 36 can be adjusted, according to the horizontal curvature of the work, by pivoting the said frame around a substantially vertical axis embodied by an anchorage rod 41 which connects the cross-member 39 to the work 20. The height of each chock 35 can be individually adjusted to allow for the shape of the longitudinal profile and/or the amount of superelevation of the work, as can be seen more particularly in FIG. 14.

The longitudinal members or stringers 37, 38 serve as rails for the handling frame 50, which mainly comprises a carriage co-operating with the rails by way of bearing rollers 42 and guide rollers 43 and extending transversely across the width of the work 20 and bearing by means of hangers 44, 45 the rig C.

As already stated, the rig C comprises a number of longitudinally-extending main mould members, such as 26 and 60, and a self-supporting structure or structural frame 21 which in the example shown is embodied by a system of three trusses — a rear truss 46, a central truss 47 and a front truss 48 — the three trusses together forming a rigid skeleton connected by the hangers 44, 45 to the handling frame 50. The handling frame 50 can therefore be moved on the rails 37, 38 to move the rig C, and thus the main mould members 26 and 60, into their working position.

Exact adjustment of rig C relatively to the already completed portion 20 of the work is by means of the abutment device 31*a*, 31*b*, 31*c*, 31*d* engaging with the complementarily-shaped locating prints 30*a*, 30*b*, 30*c*, 30*d* with which a section $V_{n-1}$ has been formed as hereinbefore described. Once it has been positioned, the rig C is rigidly secured to the already completed portion of the work by tensioning the prestressing members 22, 23, the abutment devices transferring the longitudinal compression stresses, as explained hereinbefore. The rig C can now take not only its own weight but also the weight of the section $V_n$ being concreted. When the concrete is poured, the auxiliary mould members 32*a*, 32*b*, 32*c*, 32*d* form moulds for forming the locating prints 30*a*, 30*b*, 30*c*, 30*d* which will be used to adjust the position of the rig C when the next section $V_{n+1}$ is concreted.

It has been assumed heretofore that the required work is of constant height; clearly, however, and as will be seen hereinafter, the invention is not limited to this particular case, and FIGS. 20 to 23 show an embodiment of a concreting rig, of use more particularly for in situ concreting of sections of a work whose height varies. The rig C in this case comprises three parts — a first part $C_1$ disposed opposite the underside of the bottom flange 3 of the section $V_n$ to be concreted, and two parts $C_2$, $C_3$ which are disposed laterally opposite the webs 4 and the top flange 5 of the section $V_n$. As a rule, the parts $C_1$, $C_2$, $C_3$ are rigidly interconnected, but they can be released temporarily for adjustment of the position and/or inclination of the part $C_1$ and therefore of the height of the section $V_n$ to be concreted. To simplify the drawings only a main mould member of the part $C_1$ is shown; as previously, said main mould member is equipped with two abutment members 31c, 31d and two auxiliary mould members 32c, 32d. To the rear, in the zone where the section $V_{n-1}$ is overlapped, the rig part $C_1$ has two elements $C_{1x}$ and $C_{1y}$ which project laterally outside the webs 4 and on which the rig parts $C_2$, $C_3$ bear, as can be seen in FIGS. 20, 22 and 23. The rig parts $C_2$, $C_3$ carry the other two abutment members 31*a*, 31*b* respectively and the other two auxiliary mould members 32*a*, 32*b* respectively.

The rig C is positioned and adjusted in the manner hereinbefore described with reference to FIGS. 3 to 19. After it has been positioned the rig is rigidly secured to the already completed portion of the work by means of prestressing members 122, 123, which are shown diagrammatically in FIG. 20 and which are substantially similar to the prestressing members 22, 23 hereinbefore described. In the working position of the rig, therefore, the elements $C_{1x}$ and $C_{1y}$ act as abutments via which longitudinal compressive stresses are transmitted, such stresses then being transmitted to the bottom flange 3 of the work via the locating elements 31*c*, 31*d*.

Figure 24:
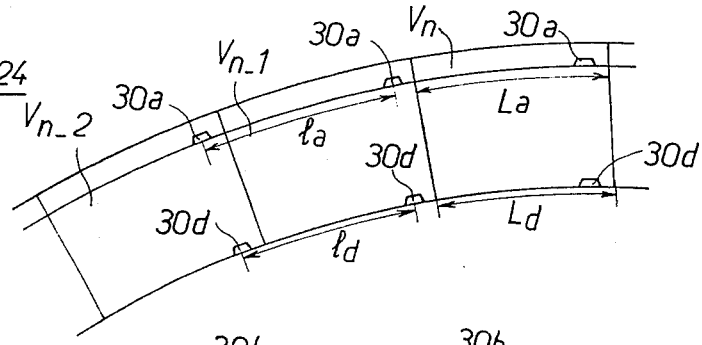
FIGS. 24, 25 and 26 are diagrams showing three different ways in which the rig can be adjusted so that the work can be given a particular longitudinal profile or horizontal curvature or superelevation.
Figure 25:
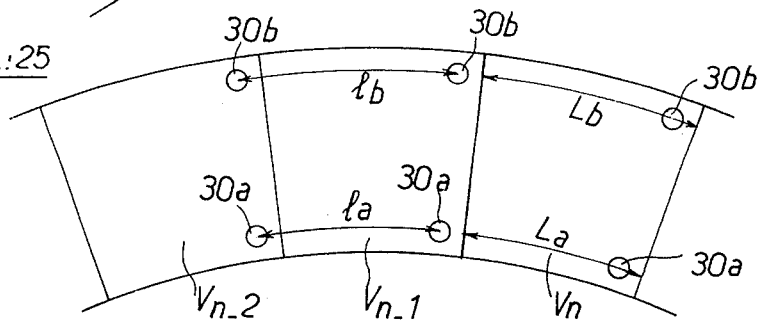
Figure 26:
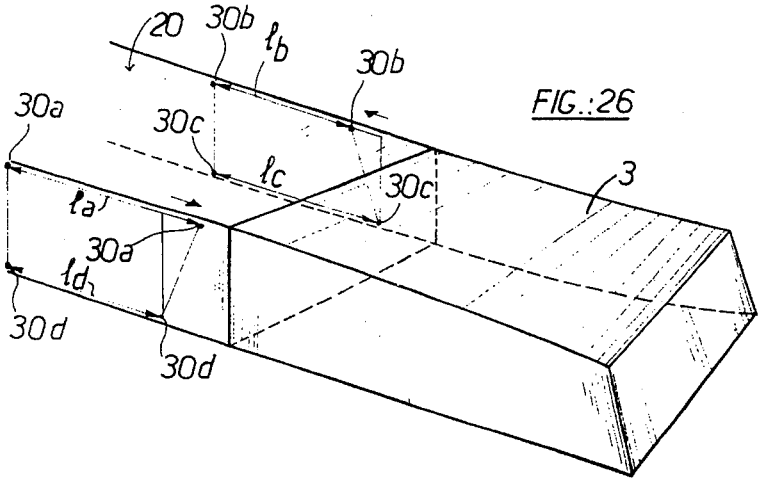

FIGS. 24 to 26 show various ways of adjusting the concreting rig so that a civil engineering work of any required pattern can be evolved.

As previously described, each section $V_{n-1}$ has four locating portions 30*a*, 30*b*, 30*c*, 30*d* (see FIG. 8) which may be thought of as defining the geometric shape and the attitude of the next section $V_n$ which is to be concreted with the use of the rig. There are two top locating portions 30*a*, 30*b* and two bottom locating portions 30*c*, 30*d*, two left-hand locating portions 30*a*, 30*d* and two right-hand locating portions 30*b*, 30*c* (as viewed in the drawings). Any two like locating portions associated with two consecutive sections such as $V_{n-2}$ and $V_{n-1}$ are separated from one another by distances $l_a$, $l_b$, $l_c$, $l_d$ respectively. Therefore $l_a$ = 30*a*—30*a*; $l_b$ = 30*b*—30*b* and so on. The simplifying assumption will be made that the work is of constant height, in which case $l_a$ usually $= l_b = l_c = l_d$.

If, for instance, the position of an impression 30*a* is altered, the associated distance $l_a$ alters correspondingly. It can be shown that the length $L_a$ near the zone considered — in the event, the top left-hand part — of a section $V_n$ is substantially equal to the distance $l_a$ between the impressions 30*a* of the immediately previous section $V_{n-1}$ and the penultimate section $V_{n-2}$. Consequently, once the distances $l_a$, $l_b$, $l_c$, $l_d$ of the last two sections are known, the lengths $L_a$, $L_b$, $L_c$, $L_d$ in the various zones considered of the section $V_n$ to be concreted, and therefore the shape and attitude of such section, can be predetermined beforehand.

FIG. 24 relates, for instance, to a work having a varying longitudinal profile. This result can be achieved simply by devising matters so that simultaneously:

$$l_a > l_d \text{ and } l_b > l_c$$

FIG. 25 relates to the case of a work having a horizontal curvature; this can be achieved by so devising matters that simultaneously:

$$l_a < l_b \text{ and } l_d < l_c$$

FIG. 26 shows how a superelevation can be provided by so devising matters that simultaneously:

$$l_a > l_d \text{ and } l_b < l_c$$

Clearly, combinations of the three forms of adjustment just described will enable the work to be given any kind of physical contour. The adjustment is made by acting, according to requirements, on the position of one or more of the four locating portions 30*a*, 30*b*, 30*c*, 30*d*. It can also be shown that only three locating portions have to be adjusted to give any movement of the rig C.

Of course embodiments described are only examples and can be modified, inter alia by the substitution of technical equivalents, without departure from the scope of the invention as defined in the appended claims.

I claim:

1. In combination with a bridge or similar elevated elongated civil engineering work under construction, a cantilever type installation for successively in situ concreting a plurality of substantially horizontally extending, longitudinally consecutive concrete sections ($V_1$, $V_2$, $V_3$ . . . $V_{n-1}$, $V_n$, . . . ) of said work, said installation comprising:

a mold-carrying rigid structural frame overhanging in longitudinal prolongation of the last concreted section ($V_{n-1}$) of an already completed portion of the work at the place where a new section ($V_n$) of the work is to be concreted, said frame presenting a first end-region which is proximal with respect to the already completed portion of the work and which overlaps the last concreted section ($V_{n-1}$), and a second end-region which is longitudinally spaced therefrom; and means fixed to said proximal end-region of said rigid structural frame for abutting said frame against already completed portion of said work in a longitudinal direction towards the completed portion; wherein the improvement comprises:

means for securing said rigid structural frame to said already completed portion of said work allowing the load resulting from the weight of said frame and of said new section ($V_n$) to be transferred to the already completed portion of the work, said securing means comprising: at least one main double ended prestressing member extending longitudinally of said work and anchored by one of its ends to said second end-region of said rigid frame and by its other end to said already-completed portion of said work, said main prestressing member being tensioned to press said rigid frame in said longitudinal direction via said abutment means against said already completed portion of said work; and at least one auxiliary double ended prestressing member which extends substantially vertically to said work and is anchored by one of its ends to said overlapping proximal end-region of the rigid frame and by its other end to said last section ($V_{n-1}$) of said completed portion of said work, said auxiliary prestressing member also being tensioned.

2. In combination with a bridge or similar elevated elongated civil engineering work under construction, said work including a side surface extending in the longitudinal direction of the work, a cantilever type installation for successively in situ concreting a plurality of substantially horizontally extending, longitudinally consecutive sections ($V_1$, $V_2$, $V_3$, . . . $V_{n-1}$, $V_n$, . . . ) of the work, said installation being of the kind comprising:

at least one elongated main mold shuttering overhanging in longitudinal prolongation of the last concreted section ($V_{n-1}$) of an already completed portion of the work at the place where a new section ($V_n$) of an already completed portion of the work at the place where a new section ($V_n$) of the work is to be concreted, said main shuttering presenting two longitudinally spaced end regions including a first end region which is proximal with respect to the already completed portion of the work and a second end region which is distant with respect thereto;

means for interconnecting said main shuttering and said last concreted section ($V_{n-1}$) of the already completed portion of the work, and for accurately positioning said main shuttering with respect to said last section, said interconnecting and positioning means including at least three mutually spaced, non-aligned abutment devices located at or near said proximal end-region of the main shuttering and each engaging with respective complementarily-shaped locating print formed in the said surface of said last section ($V_{n-1}$) of the already completed portion of the work; and at least three auxiliary mold members located at said distant end-region of the main shuttering, each being in respective longitudinal alignment with a corresponding one of the said abutment devices for molding in said new section ($V_n$) of the work, locating prints for subsequent engagement with said abutment devices during the concreting of its next section ($V_{n+1}$) of the work; wherein the improvement comprises:

at least one rectilinear elongated guideway fixed in position with respect to said main shuttering and extending in the longitudinal direction of said shuttering at the distant end-region thereof and in longitudinal alignment with one of the said abutment devices;

a slide-block integral with the one of said auxiliary mold members which corresponds to said one abutment device and slidable along said longitudinal guideway whereby said one auxiliary mold member is adjustable along a longitudinal path with respect to said main shuttering; and clamping means for locking said adjustable auxiliary mold member in any preselected position within said longitudinal path.

3. In combination with a bridge or similar elevated, elongated civil engineering work under construction, said work presenting a side surface extending in the longitudinal direction of the work, a cantilever-type installation for successively in situ concreting a plurality of substantially horizontally extending, longitudinally consecutive sections of the work, said installation being of the kind comprising:

at least one elongated main mold shuttering overhanging in longitudinal prolongation of the last concreted section of an already-completed portion of the work at the place where a new section of the work is to be concreted, said main shuttering presenting two longitudinally spaced end-regions including a first end-region which is proximal with respect to the already-completed portion of the work and a second end-region which is distant with respect thereto;

positioning means interconnecting said main shuttering with respect to said last section, said positioning means including at least three mutually spaced, non-aligned abutment devices located at said proximal end-region of the main shuttering and each engaging with a respective complementarily-shaped locating print formed in the side surface of the last section of the already completed portion of the work; and at least three auxiliary mold members located at said distant end-region of the main shuttering, each in respective longitudinal alignment with a corresponding one of the said abutment devices for molding in said new section of the work, locating prints for subsequent engagement with said abutment devices during the concreting of the next section of the work; wherein the improvement comprises:

at least one rectilinear elongated guideway fixed in position with respect to said main shuttering and extending in the longitudinal direction of said shuttering at the proximal end-region thereof and in longitudinal alignment with one of the said auxiliary mold members;

a slide-block integral with one of said abutment devices which corresponds to said one auxiliary mold member and slidable along said longitudinal guideway whereby said one abutment device is adjustable along a longitudinal path with respect to said main longitudinal shuttering; and clamping means for locking said adjustable abutment device in any preselected position within said longitudinal path.

* * * * *